US010266355B2

(12) United States Patent
Schneider

(10) Patent No.: US 10,266,355 B2
(45) Date of Patent: Apr. 23, 2019

(54) DEVICE FOR SEPARATING SHEET MATERIAL

(71) Applicant: GIESECKE+DEVRIENT CURRENCY TECHNOLOGY GMBH, München (DE)

(72) Inventor: Stefan Schneider, Kirchheim (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/566,857

(22) PCT Filed: Apr. 15, 2016

(86) PCT No.: PCT/EP2016/000621
§ 371 (c)(1),
(2) Date: Oct. 16, 2017

(87) PCT Pub. No.: WO2016/165830
PCT Pub. Date: Oct. 20, 2016

(65) Prior Publication Data

US 2018/0127224 A1 May 10, 2018

(30) Foreign Application Priority Data

Apr. 16, 2015 (DE) ..... 10 2015 004 875

(51) Int. Cl.
*B65H 3/10* (2006.01)

(52) U.S. Cl.
CPC ..... *B65H 3/10* (2013.01); *B65H 2406/332* (2013.01); *B65H 2406/3614* (2013.01); *B65H 2601/521* (2013.01); *B65H 2701/1912* (2013.01)

(58) Field of Classification Search
CPC ..... B65H 3/10; B65H 2404/1362; B65H 2404/1363; B65H 2406/3122;
(Continued)

(56) References Cited

U.S. PATENT DOCUMENTS 3,669,446 A * 6/1972 Derc ..... B62D 3/02 271/104
6,416,049 B1 * 7/2002 Mitzel ..... B65H 3/10 271/108
(Continued)

FOREIGN PATENT DOCUMENTS

DE 1917795 A1 11/1969
DE 2814306 A1 10/1979
(Continued)

OTHER PUBLICATIONS

German Search Report from DE Application No. 10 2015 004 875.9, dated Dec. 11, 2015.
(Continued)

*Primary Examiner* — Michael C McCullough
(74) *Attorney, Agent, or Firm* — Workman Nydegger

(57) ABSTRACT

An apparatus for singling sheet goods which comprises a suction device with a stator and a rotor movable relative to the stator. The stator has at least one first opening and the rotor at least one second opening which overlap upon a rotation of the rotor and thereby define an opening area with a first end and a second end. The opening area extends starting from the first end up to the second end, wherein a section of the opening area between the first end and the second end forms a suction area in which sheet goods to be singled can be sucked by the suction device. The first end of the opening area is arranged spaced from the suction area so that arising noise can be dampened.

13 Claims, 4 Drawing Sheets

(58) Field of Classification Search
CPC ..... B65H 2406/331; B65H 2406/361; B65H 2406/3614
USPC ..... 271/94, 96
See application file for complete search history.

(56) References Cited

U.S. PATENT DOCUMENTS

| | | | | |
|---|---|---|---|---|
| 6,918,581 | B2 * | 7/2005 | Horiuchi | B65H 3/08 271/104 |
| 2003/0075855 | A1 * | 4/2003 | Andreyka | B65H 3/10 271/94 |
| 2011/0101599 | A1 * | 5/2011 | Hiramitsu | B65H 3/10 271/96 |

FOREIGN PATENT DOCUMENTS

| | | | |
|---|---|---|---|
| DE | 19953968 | A1 | 5/2001 |
| EP | 1411009 | A2 | 4/2004 |
| EP | 1997754 | A2 | 12/2008 |
| FR | 2006566 | A1 | 12/1969 |

OTHER PUBLICATIONS

International Search Report from PCT Application No. PCT/EP2016/000621, dated Jul. 1, 2016.

* cited by examiner

FIG 1 (State of the art)

DEVICE FOR SEPARATING SHEET MATERIAL

BACKGROUND

The present invention relates to an apparatus for singling sheet goods, in particular bank notes, checks and the like, having a suction device for sucking sheet goods to be transported.

An apparatus for singling sheet goods can be provided, for example, in an apparatus for processing sheet goods, such as an automatic teller machine or a bank-note processing apparatus, to single sheet goods of a sheet-goods stack. The singling apparatus can be configured as a singling roller which comprises a first section in the form of a substantially cylindrical stator and a second section in the form of a rotor which rotates around the stator. The stator has at least one opening which is subjected to a vacuum. The opening of the stator can extend along the length of the stator and over a certain aperture angle in circumferential direction, which can extend from an opening edge. The rotor likewise has at least one opening, usually a plurality of openings or bores, which during the rotation of the rotor around the stator overlap with the opening of the stator and thereby define an opening area. A suction area is thereby formed in the circumferential direction, in which sheet goods to be singled are sucked and drawn from a sheet-goods stack. Here, the singler acts like a kind of rotary slide valve to suck sheet goods into the suction area. Such an apparatus for singling sheet goods is known for example from DE 199 53 968 A1.

When the openings of the rotor move past the opening edge of the stator, i.e. at a first end of the opening area at which the openings of the rotor and the opening of the stator begin to overlap, an opening bang from the applied vacuum and the abrupt opening arises. Reducing the resulting noise by slanting the opening edge relative to the longitudinal axis is already known from DE 199 53 968 A1, because the openings of the rotor do not all simultaneously hit the opening edge of the stator. A similar effect can be attained by an offset arrangement of the openings of the rotor. In order to reduce the noise, it is proposed in DE 199 53 968 A1 to relocate the first end of the opening area to an already exposed area after passing a guiding device to avoid additional swirls generated by the vacuum.

SUMMARY

The object is achieved by an apparatus for singling sheet goods having the features of the independent claim. Developments and advantageous embodiments are stated in the claims dependent thereon.

An apparatus for singling sheet goods comprises a suction device having a first section and a second section movable relative to the first section. The first section has at least one first opening and the second section at least one second opening which overlap upon a movement of the second section relative to the first section and thereby define an opening area having a first end and a second end. The opening area extends beginning from the first end up to the second end, i.e. upon the motion of the second section relative to the first section, the openings of the first and second section begin to overlap at the first end. A section of the opening area between the first end and the second end thereby forms a suction area in which sheet goods to be singled can be sucked by the suction device. Advantageously, the first section has an attachment for applying a vacuum, which is connected to the at least one first opening, i.e. the first section is subjected to a vacuum.

According to the invention, the first end of the opening area is arranged spaced from the suction area. In contrast hereto, the suction area coincides with the opening area for the above-described known apparatus so that the first end of the opening area is also an end of the suction area. For the known apparatus, the opening bang arises at the exposed first end directly in the singler gap where it cannot be dampened and often points in the direction of an operator. According to the present invention, the first end of the opening area, thus the place at which the opening bang arises through the beginning overlap of the openings, lies in an area which is away from the suction area. The first end therefore lies in an area of the apparatus in which no sheet goods are transported so that there is the possibility of dampening the arising noise, for example by a corresponding housing. Furthermore, the first end then advantageously points away from an operating person so that the operating person is subjected to less noise.

A further advantage of the arrangement according to the invention of the first end of the opening area being spaced from the suction area is the fact that the energy consumption of the apparatus can be reduced. In known apparatuses, the vacuum must be built up very quickly because the suction area is congruent to the opening area. In contrast, in the apparatus of the present invention the distance from the first end of the opening area up to the suction area can be utilized to build up a vacuum in the openings of the second section. In this time span, a vacuum can be built up with reduced energy consumption.

Preferably the first section of the suction device is configured as a substantially cylindrical stator and the second section as a substantially cylindrical rotor arranged and rotatable around the stator. The suction device is therefore preferably configured as a singler roller. This acts on the principle of a rotary slide pump. It will be appreciated that the apparatus for singling sheet goods can, for example, also be configured such that the second section moves in a linear motion relative to the first section.

Preferably the first end of the opening area is spaced from the suction area along the circumference of the suction device by at least 45°, preferably at least 60°, further preferably at least 90°, still further preferably at least 120°. The distance between the first end of the opening area and the suction area can be chosen such that an effective noise reduction can be attained.

The first section of the suction device, which can be configured in particular as a stator, can be configured such that the first opening extends along its longitudinal direction and has an opening edge, which extends along the longitudinal direction. Preferably the opening edge defines the first end of the opening area, wherein the first opening extends from the opening edge along the circumference of the stator over an angle of at least 120°, preferably at least 150°, further preferably at least 180°. Optionally, a smaller aperture angle, for example 90°, can also be enough, provided that the first end of the opening area is arranged spaced from the suction area. By choosing a corresponding angle and a corresponding arrangement of the stator, the distance between the first end of the opening area and the suction area can be defined. Here, a greater distance can be advantageous. In case of a cylindrical stator, the first end of the opening area can, for example, lie along a diameter of the stator vis-à-vis with the suction area.

In an advantageous embodiment, the apparatus has a guiding device which can define a beginning of the suction area. The guiding device can, for example, be configured as a guide plate which a sheet-goods stack lies against prior to singling. In particular, the guiding device can be configured as an air baffle plate which directs the sheet goods to be singled in a desired direction by means of compressed air, in particular in the direction of the suction area of the suction device. The first end of the opening area lies preferably in moving direction of the second section behind the guiding device so that the first end of the opening area is not exposed.

As a further measure for noise reduction, the opening edge can run at an angle to the longitudinal axis so that the opening area does not begin altogether abruptly. Alternatively or additionally, the opening edge can be beveled. This allows a gentle opening upon the overlapping of the opening of the stator and the openings of the rotor in comparison to an opening edge without bevel.

Advantageously, the apparatus has a cover which covers the first end of the opening area. The cover is preferably devised to dampen a noise which occurs at the start of the overlap of the first opening and the second opening at the first end of the opening area. In particular, the cover can for this purpose consist of a noise-dampening material and/or be shaped accordingly.

The second section, which can be configured in particular as a rotor, can likewise have features which can contribute to the noise reduction. Preferably the second section can have a plurality of the second openings, which are arranged in rows transversely to the moving direction of the second section. If the second section is configured as a cylindrical rotor, the rows can run in particular along the length parallel to the longitudinal axis of the rotor. Here, the plurality of the second openings in neighboring rows can be arranged offset. This leads to a time-shifted opening. Alternatively or additionally, the plurality of the second openings in different rows can have different sizes. Preferably, those openings which first overlap with the opening of the first section upon the motion of the second section relatively to the first section can be configured smaller so that the sheet goods are drawn toward the suction device with increasing force.

BRIEF DESCRIPTION OF THE DRAWINGS

The invention will hereinafter be described by way of example with reference to the schematic drawings. Therein are shown.

DETAILED DESCRIPTION OF VARIOUS EMBODIMENTS

Figure 1:
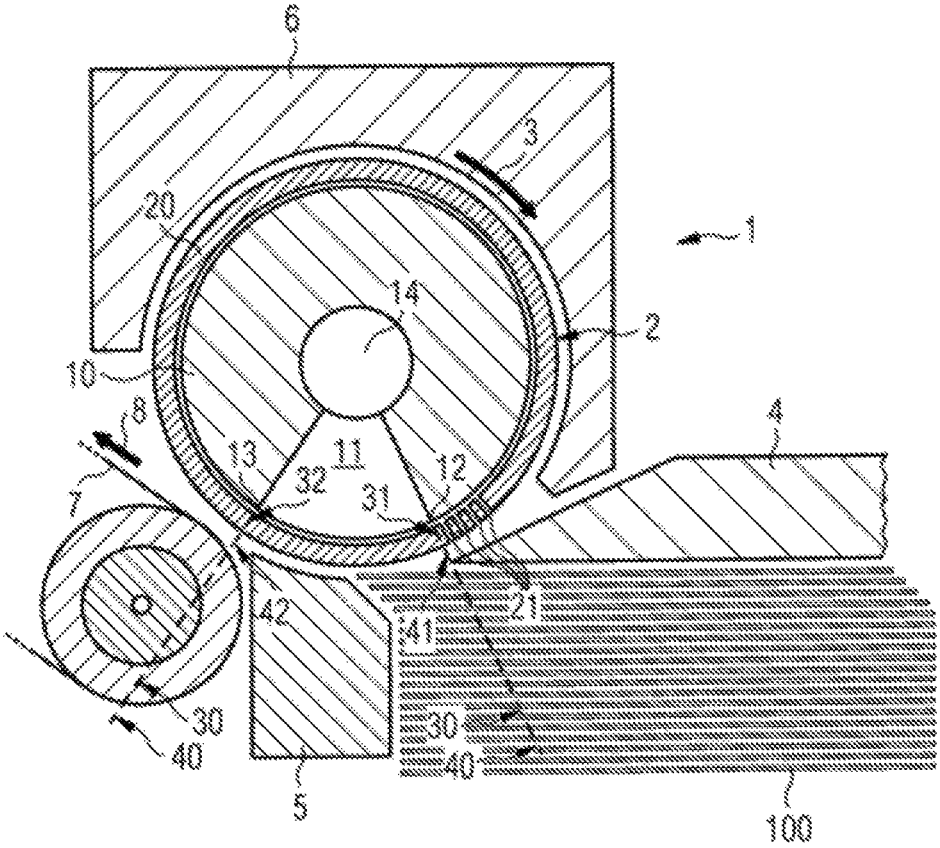
FIG. 1 an apparatus for singling sheet goods from the prior art.

In FIG. 1, an apparatus 1 is schematically represented for singling sheet goods, in particular bank notes, as it is known from the prior art. The apparatus 1 has a suction device 2 in the form of a singler roller having a stator 10 and a rotor 20 rotatable around the stator 10. The moving direction of the rotor 20 is marked by the arrow 3. In contrast to the prior art, the suction device 2 is arranged in a housing 6. A stack of sheet goods 100, for example a stack of bank-notes, is fed to the apparatus 1 and lies against a guiding device 4 in the form of an air baffle plate, which conveys the uppermost piece of sheet goods 100 by means of compressed air from the stack in the direction of the suction device 2. The schematic structure and basic function of the air baffle plate is known from DE 28 14 306 A1, for example. During singling, the remaining stack, in particular the pieces immediately following the uppermost piece of the sheet-goods stack, is held back by means of a retaining device 5 to avoid double and multiple picks. The retaining device 5 can likewise act by means of compressed air and be configured like an air baffle plate, which utilizes the hydrodynamic paradox occurring in the air baffle plate in connection with the stagnation pressure forces for the purpose of holding back the pieces of sheet goods following the uppermost piece. Likewise, the retaining device 5 can act with a vacuum to hold back the pieces of sheet goods following the uppermost piece. The retaining device 5 can be also configured as a roller, which rotates opposite to the singler roller 2. For the retention of the sheet goods, the roller has friction areas or likewise acts by means of a vacuum. After the singling, the singled sheet goods are transported off in a transport direction 8 by means of a transport device 7.

The singling of the sheet goods 100 is effected by means of a vacuum so that the sheet goods 100 to be singled are sucked by the suction device 2, drawn from the stack and then released. For this purpose the stator 10 has an access 14, which is connected to an apparatus for generating a vacuum (not represented). Here, the access 14 is configured as a central bore along the longitudinal axis of the stator 10, it can, however, be configured arbitrarily in order to subject the stator 10 to a vacuum. The access 14 is connected with an opening 11 of the stator 10 which extends along the length of the stator 10 and in the circumferential direction from an opening edge 12 up to an edge 13. The opening 11 forms an open sector of the stator 10 which can extend, for example, over an angle of 60°.

The rotor 20 has several openings 21 which upon a rotation of the rotor 20 around the stator 10 overlap with the opening 11 of the stator 10. The overlap begins upon the rotation of the rotor 20 at the opening edge 12 and ends at the edge 13. An opening area 30 having a first end 31 and a second end 32 is thereby defined, i.e. that area along the circumference of the suction device 2 which the applied vacuum can reach through the openings 21. Simultaneously, a suction area 40 having a first end 41 and a second end 42 is thereby formed along the circumference of the suction device 2 in which sheet goods 100 to be singled can be sucked.

In the known apparatus 1 represented in FIG. 1, the opening area 30 and the suction area 40 are congruent. With regard to the moving direction 3, the first end 31 of the opening area 30 or the first end 41 of the suction area 40 lies before an edge of the air baffle plate 4 or, where applicable, at the same level relative to the circumference of the suction device 2. The sheet goods to be singled 100 is sucked in the suction area 40 and released upon reaching the second end 32 of the opening area 30 or the second end 42 of the suction area 40, because the openings 21 of the rotor 20 are again closed by the rotation of the rotor 20. After the intermittent drive by the singler roller 2, the sheet goods can then be transported off by means of the transport device 7.

As soon as the openings 21 of the rotor 20 reach the opening edge 12 of the stator 10, they open abruptly, whereby an opening bang arises. This arises in the singler gap being exposed and passes undampened in the direction of an operating person. For a fast singling apparatus with a high rotating speed of the singler roller, this opening bang can occur, for example, 44 times per second.

Figure 2:
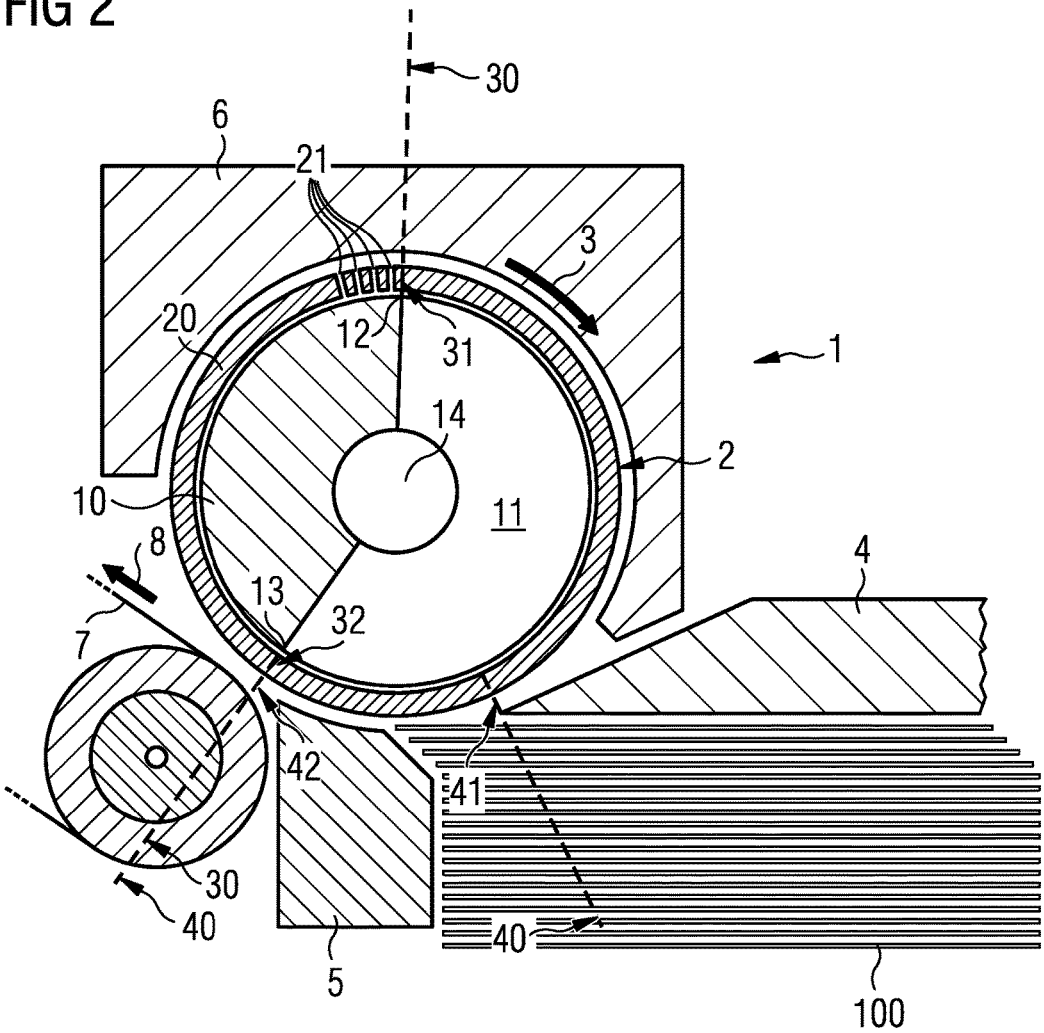
FIG. 2 an apparatus for singling sheet goods according to the invention.

In FIG. 2, an embodiment example of the present invention is represented. The apparatus 1 for singling sheet goods 100 resembles in wide sections the known apparatus described in connection with FIG. 1. It differs, however, in the realization of the opening 11 of the stator 10. In comparison to the known apparatus, the opening 11 extends over a much farther circumferential portion of the stator 10 so that the first end 31 of the opening portion 30, which is formed by the opening edge 12 of the opening 11, is spaced from the suction area 40. In other words, according to the invention, the opening area 30 and the suction area 40 do not coincide, rather the suction area 40 is merely a section of the opening area 30. Accordingly, the corresponding first ends 31 and 41 also do not coincide, rather the first end 31 of the opening area 30 is spaced from the first end 41 of the suction area 40. In this embodiment example, the distance of the first ends 31 and 41 along the circumference amounts to about 150°.

By shifting the first end 31 of the opening area 30 away from the suction area 40, i.e. away from the singler gap being exposed, the opening bang arising at the first end 31 can be dampened. For this purpose, the cover or the housing 6 is configured as a noise-dampening material. It surrounds the area of the singler roller 2 in which the first end 31 of the opening area 30 is arranged and preferably also the front faces of the singler roller 2. In this manner the noise level of the apparatus 1 during operation can be reduced considerably. Exemplary measurements of the sound level in the center of the singler roller 2 in a distance of 20 mm yielded a reduction of 1.5 dB(A) without the housing 6. With a housing a further reduction can be attained, for example of about 1 dB(A).

Furthermore, the energy consumption of the apparatus can be reduced because the vacuum necessary for the singling does not need to be available abruptly, as this is the case in the apparatus according to FIG. 1, where the first end 31 of the opening area 30 and the first end 41 of the suction area 40 coincide. In the apparatus 1 according to FIG. 2, the first end 31 of the opening area 30 is spaced from the first end 41 of the suction area 40 so that this distance can be utilized for attaining a sufficient vacuum in the openings 21. For this, the total vacuum applied in the stator 10 can be less than in the known apparatus according to FIG. 1. The generation of the vacuum from excess pressure by means of the ejector principle can be effected through the reduced energy demand of the apparatus and by simultaneously employing the principle of the air baffle plate for the retaining device 5 (see above). It is thereby possible to dispense with a separate aggregate for the vacuum generation, which results in further improvements as to energy consumption and noise reduction.

Figure 3:
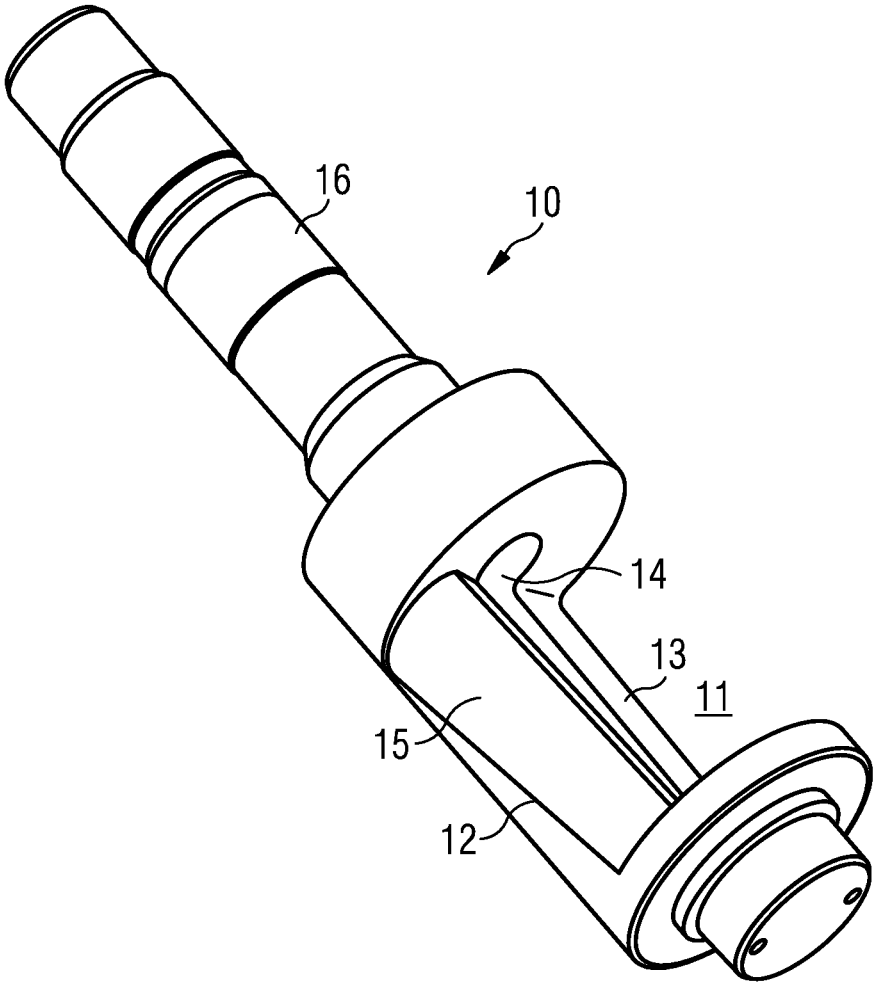
FIG. 3 the stator from the apparatus according to FIG. 2.
Figure 4A:
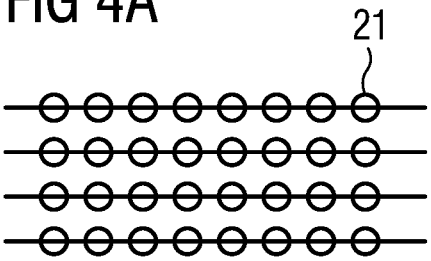
FIGS. 4*a*-4*d* different schematic representations of openings of a rotor of an apparatus for singling sheet goods.
Figure 4C:
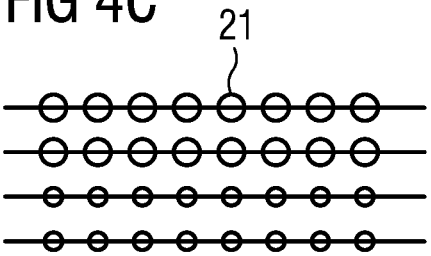
Figure 4B:
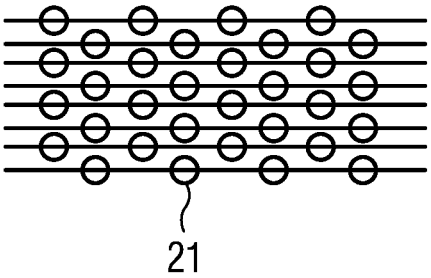
Figure 4D:
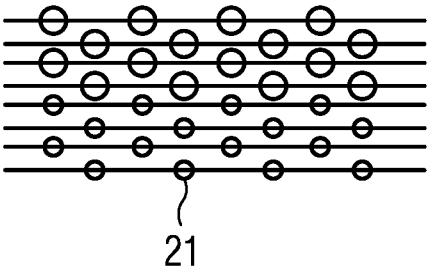

In FIG. 3, the stator 10 of the apparatus 1 of FIG. 2 is represented in a perspective view. A fitting 16 serves for attaching to an apparatus for generating a vacuum which is applied to the opening 11 at the access 14. The opening edge 12 of the opening 11 can be recognized, which is obliquely arranged with regard to the longitudinal axis of the stator 10 to further reduce the noise level, i.e. it runs not parallel but at an angle to the longitudinal axis. In this way it is attained that not all openings 21 of the rotor 20 open simultaneously but gradually. A gentle opening is further attained by a bevel 15 at the opening edge 12. The opening bang is thereby reduced when the openings 21 of the rotor 20 hit the opening edge 12.

In FIG. 4, the different patterns in which the openings 21 can be arranged along the rotor 20 are schematically represented. In FIG. 4A, the openings are all equally large and arranged uniformly in rows. A time-shifted opening can be attained by an offset of the openings 21 as in FIG. 4B, similar to the slant of the opening edge 12 of the opening 11, whereby a noise reduction can be attained. Alternatively or additionally, the openings 21 can have different sizes, as is represented in FIGS. 4C and 4D. The openings 21, which reach the opening edge 12 first, are configured smaller.

In this way, an abutting of the sheet goods 100 against the rotor 20, which can likewise cause an annoying noise, is reduced. A gentler clinging of the sheet goods 100 to the rotor 20 can be attained by the differently large openings 21 because the sheet goods 100 are drawn toward the rotor 20 with increasing force and not abruptly.

The invention claimed is:

1. An apparatus for singling sheet goods, comprising a suction device with a first section and a second section movable relative to the first section, wherein the first section has at least one first opening and the second section at least one second opening which overlap upon a motion of the second section relative to the first section and thereby define an opening area with a first end and a second end, wherein the opening area extends starting at the first end up to the second end and a section of the opening area between the first end and the second end forms a suction area in which sheet goods to be singled can be sucked by the suction device, wherein the first end of the opening area is arranged spaced from the suction area;

the first section of the suction device is configured as a substantially cylindrical stator and the second section as a substantially cylindrical rotor arranged and rotatable around the stator;

the first opening of the stator extends along a longitudinal direction and has an opening edge, which extends along the longitudinal direction of the first opening;

the opening edge defines the first end of the opening area and the first opening extends from the opening edge along the circumference of the stator over an angle of at least 120°; and the at least one second opening extending along a circumference of the rotor over an angle that is smaller than the extension of the first opening.

2. The apparatus according to claim 1, wherein the first end of the opening area is spaced from the suction area along the circumference of the suction device by at least 45°.

3. The apparatus according to claim 1, wherein the opening edge runs at an angle to the longitudinal axis of the stator.

4. The apparatus according to claim 1, wherein the opening edge is beveled.

5. The apparatus according to claim 1, furthermore comprising a cover which covers the first end of the opening area.

6. The apparatus according to claim 5, wherein the cover is devised to dampen a noise which arises at the start of the overlap of the first opening and the second opening at the first end of the opening area.

7. The apparatus according to claim 1, wherein the second section has a plurality of the second openings, which are arranged in rows transversely to the moving direction of the second section.

8. The apparatus according to claim 7, wherein the plurality of the second openings are arranged offset in neighboring rows.

9. The apparatus according to claim 7, wherein the plurality of the second openings have different sizes in different rows.

10. The apparatus according to claim 1, furthermore comprising a guiding device which defines a start of the suction area.

11. The apparatus according to claim 1, wherein the first section has an attachment for applying a vacuum, which is connected to the at least one first opening.

12. An apparatus for processing sheet goods, comprising at least one apparatus for singling sheet goods according to claim 1.

13. An apparatus for singling sheet goods, comprising a suction device with a first section and a second section movable relative to the first section, wherein the first section has at least one first opening and the second section at least one second opening which overlap upon a motion of the second section relative to the first section and thereby define an opening area with a first end and a second end, wherein the opening area extends starting at the first end up to the second end and a section of the opening area between the first end and the second end forms a suction area in which sheet goods to be singled can be sucked by the suction device, wherein the first end of the opening area is arranged spaced from the suction area;

the suction device further comprising a cover which covers the first end of the opening area, a section of a surface of the cover being concentric with the first section.

* * * * *